US010063000B2

(12) United States Patent
Nishide

(10) Patent No.: US 10,063,000 B2
(45) Date of Patent: Aug. 28, 2018

(54) SPLIT CONNECTOR

(71) Applicant: Sumitomo Wiring Systems, Ltd., Yokkaichi, Mie (JP)

(72) Inventor: Satoru Nishide, Mie (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 15/671,208

(22) Filed: Aug. 8, 2017

(65) Prior Publication Data

US 2018/0062299 A1 Mar. 1, 2018

(30) Foreign Application Priority Data

Aug. 26, 2016 (JP) ..... 2016-165519

(51) Int. Cl.

| | |
|---|---|
| ***H01R 13/514*** | (2006.01) |
| ***H01R 13/436*** | (2006.01) |
| ***H01R 13/432*** | (2006.01) |
| ***H01R 13/627*** | (2006.01) |
| ***H01R 13/641*** | (2006.01) |
| *H01R 13/74* | (2006.01) |

(52) U.S. Cl.

CPC ..... *H01R 13/4368* (2013.01); *H01R 13/432* (2013.01); *H01R 13/6272* (2013.01); *H01R 13/641* (2013.01); *H01R 13/514* (2013.01); *H01R 13/743* (2013.01)

(58) Field of Classification Search

CPC ..... H01R 13/4368; H01R 13/4362; H01R 13/432; H01R 13/6272; H01R 13/641; H01R 13/514; H01R 13/743

USPC ..... 439/595, 733.1, 752

See application file for complete search history.

(56) References Cited

U.S. PATENT DOCUMENTS 7,108,551 B2 * 9/2006 Nishide ..... H01R 13/6272 439/595

2005/0095876 A1 5/2005 Nishide

FOREIGN PATENT DOCUMENTS

JP 2005-135685 5/2005

* cited by examiner

*Primary Examiner* — Khiem Nguyen

(74) *Attorney, Agent, or Firm* — Gerald E. Hespos; Michael J. Porco; Matthew T. Hespos

(57) ABSTRACT

A split connector includes a housing (10) with an accommodating portion (12) and sub-connectors (20) are inserted into the accommodating portion (12). Terminal fittings (23) and retainers (30) are inserted into the sub-connectors (20). Guide recesses (14L, 14R) are formed on an inner surface of the accommodating portion (12) and extend along an inserting direction of the sub-connectors (20) into the accommodating portion (12). Guide projections (29L, 29R) are formed on outer surfaces of the sub-connectors (20) and fit into the guide recesses (14L, 14R) in an inserting process into the accommodating portion (12). Detecting projections (34L, 34R) on outer surfaces of the retainer (30) are configured not to fit into the guide recesses (14L, 14R) when the retainers (30) are at a partial locking position but fit into the guide recesses (14L, 14R) when the retainers (30) are at a full locking position.

7 Claims, 7 Drawing Sheets

SPLIT CONNECTOR

BACKGROUND

1. Field of the Invention

The invention relates to a split connector.

2. Description of the Related Art

Japanese Unexamined Patent Publication No. 2005-135685 discloses a split connector with a housing body including an accommodating portion and sub-connectors that can be accommodated into the accommodating portion. Terminal fittings are inserted into the sub-connector and a retainer retains the inserted terminal fittings. The retainer is supported on the sub-connector via an easily deformable thin hinge, and is pivotable about the hinge between a partial locking position and a full locking position.

The retainer is placed at the partial locking position prior to inserting the terminal fittings and is displaced to the full locking position after the terminal fittings are inserted so that the retainer retains the properly inserted terminal fittings in the sub-connector. However, an insufficiently inserted terminal fitting interferes with the retainer and prevents the retainer from being displaced to the full locking position.

A retainer that is at the full locking position is located entirely inside the sub-connector. However, a retainer that is at the partial locking position projects from the outer surface of the sub-connector and interferes with an opening edge of the accommodating portion if an attempt is made to insert the sub-connector into the accommodating portion with the retainer at the partial locking position. Thus, an insufficiently inserted terminal fitting can be detected.

The retainer is supported on the sub-connector about the hinge, and interference with the opening edge of the accommodating portion can pivot the retainer away from the full locking position. This prevents detection that the retainer is at the partial locking position and hence prevents detection of any insufficiently inserted terminal fitting.

The invention was completed based on the above situation and aims to reliably detect that a retainer is at a partial locking position.

SUMMARY

The invention is directed to a split connector with a housing that has an accommodating portion, and a sub-connector that is insertable into the accommodating portion. A terminal fitting is inserted into the sub-connector in an inserting direction. A retainer is mounted slidably into the sub-connector in a direction intersecting the inserting direction of the terminal fitting and can move between a partial locking position and a full locking position. The terminal fitting can be inserted when the retainer is at the partial locking position. However, the retainer that is moved to the full locking position locks and retains the properly inserted terminal fitting. A guide recess is formed on an inner surface of the accommodating portion and extends parallel to an inserting direction of the sub-connector into the accommodating portion. A guide projection is formed on an outer surface of the sub-connector and can fit into the guide recess. A detecting projection is formed on an outer surface of the retainer and does not fit into the guide recess when the retainer is at the partial locking position, but fits into the guide recess when the retainer is at the full locking position.

The detecting projection of the retainer that is at the partial locking position interferes with an opening edge of the accommodating portion when attempting to insert the sub-connector into the accommodating portion, thereby indicating that the retainer is at the partial locking position. The retainer is not pivoted about a hinge, but rather is slid in a direction intersecting the inserting direction of the terminal fitting. Thus, the retainer remains held at the partial locking position even if the detecting projection interferes with the opening edge of the accommodating portion.

The detecting projection may be aligned with the guide projection when the retainer is at the full locking position. Thus, the partial locking position and the full locking position the retainer can be confirmed visually.

The guide projection and the detecting projection may interfere with an opening edge of the accommodating portion when the sub-connector is going to be inserted into the accommodating portion in a laterally inverted orientation with respect to an axis parallel to the inserting direction. Thus, the sub-connector cannot be inserted into the accommodating portion in a laterally inverted improper orientation.

The guide projection and the detecting projection are provided on each of the left and right sides, and the shapes and dimensions of the guide recesses, the guide projections and the detecting projections are different on the left and right sides. Thus, the orientation of the sub-connector can be confirmed visually before inserting the sub-connector into the accommodating portion.

DETAILED DESCRIPTION

One embodiment of the invention is described with reference to FIGS. 1 to 10. Note that, in the following description, a right side in FIG. 3 and a left side in FIGS. 6, 7, 9 and 10 are defined as a front side concerning a front-rear direction. Upper and lower sides shown in FIGS. 1 to 10 are directly defined as upper and lower sides concerning a vertical direction. Left and right sides shown in FIGS. 1, 2, 5 and 8 are directly defined as left and right sides concerning a lateral direction. A split connector of this embodiment is configured by assembling one housing 10 and four sub-connectors 20.

<Housing 10>

Figure 1:
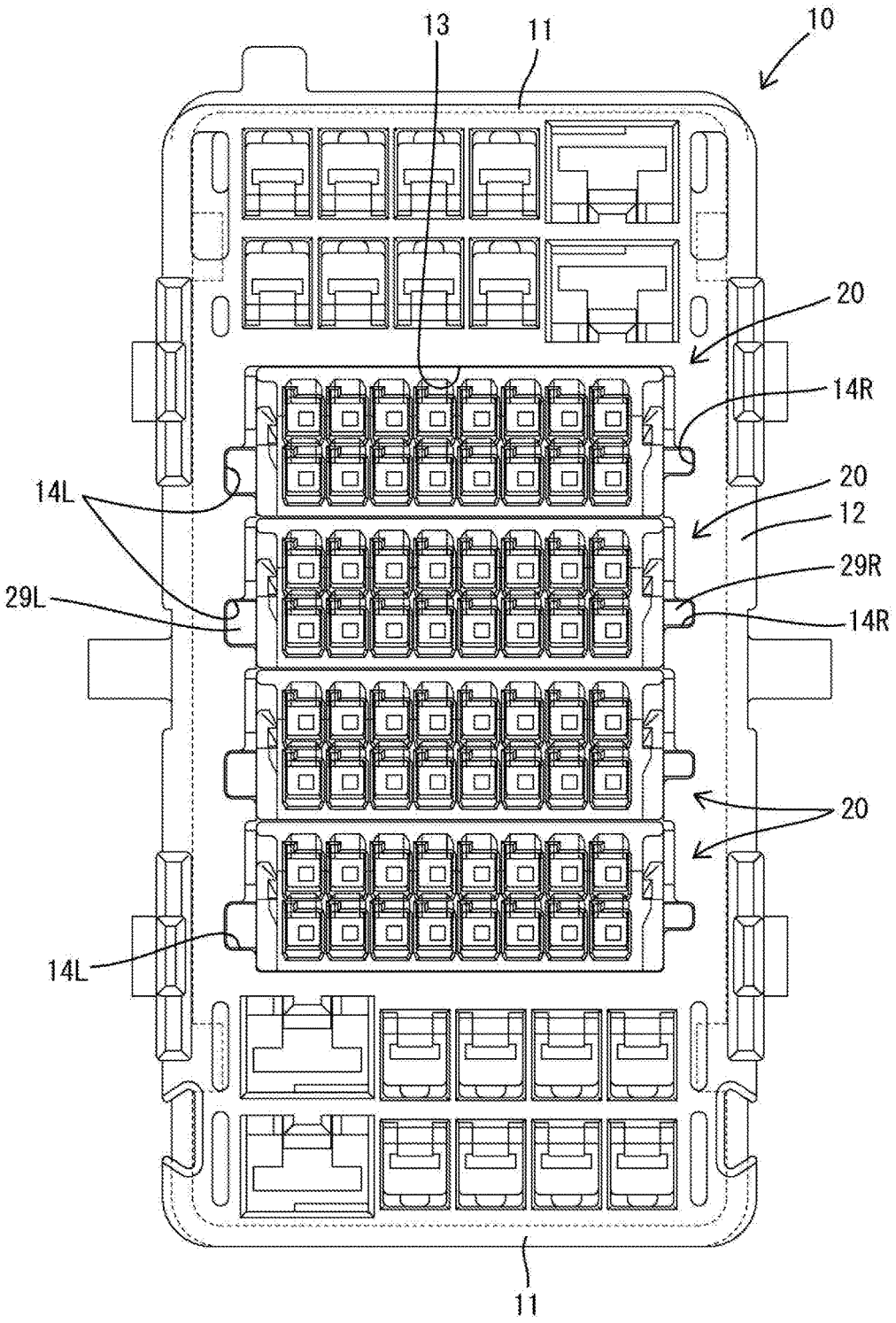
FIG. 1 is a back view of a split connector of one embodiment.
Figure 2:
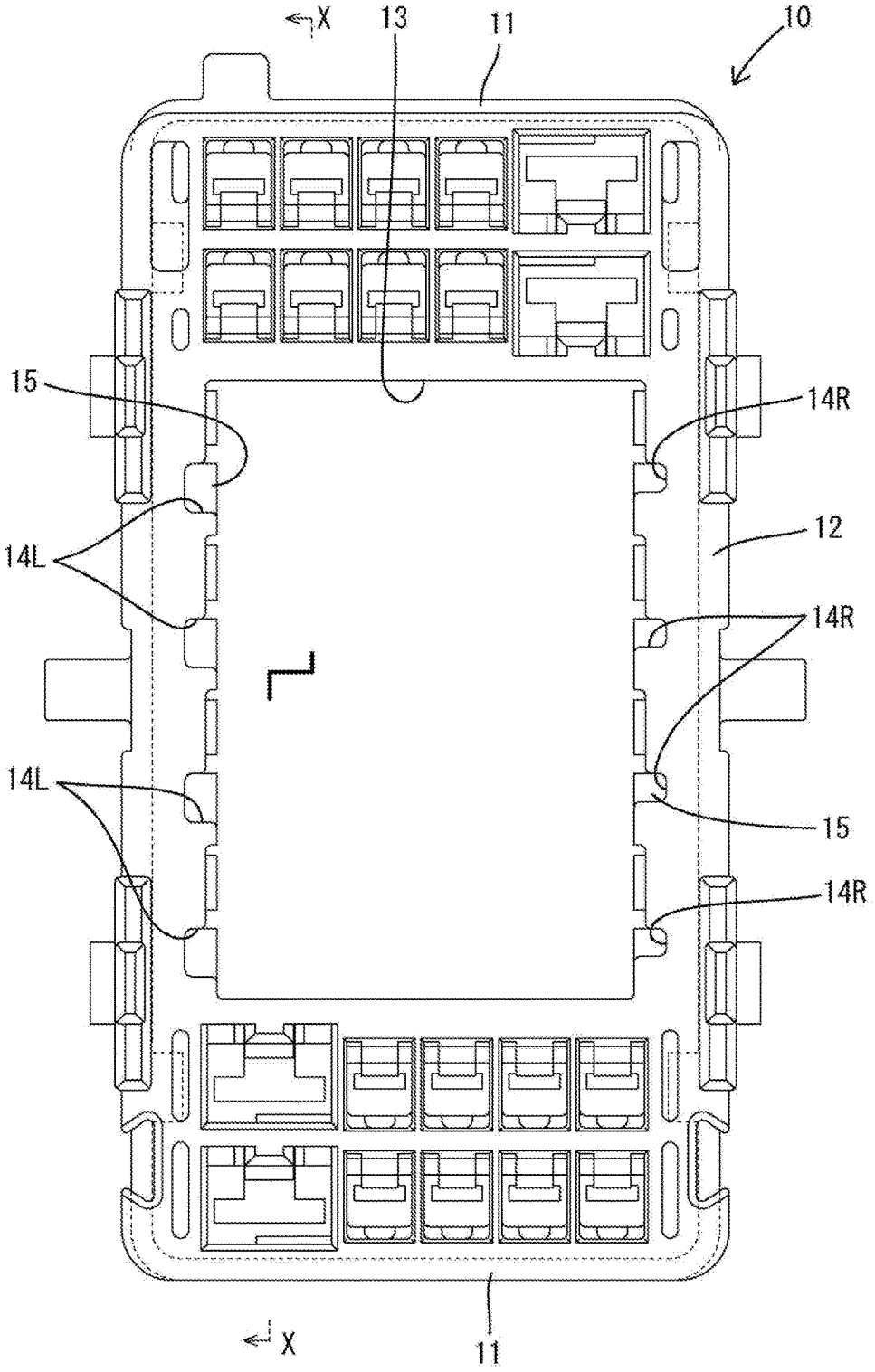
FIG. 2 is a back view of a housing.
Figure 3:
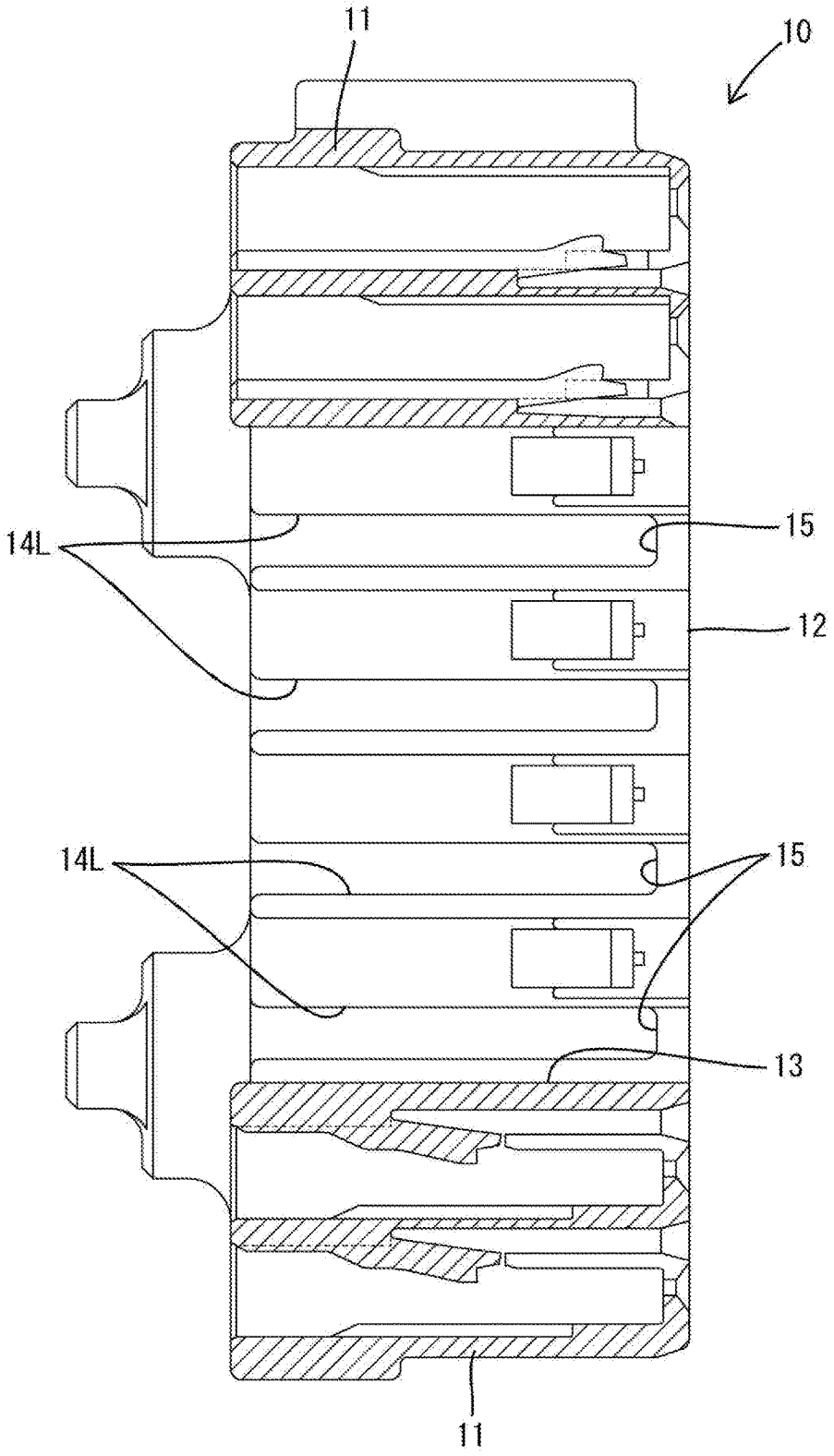
FIG. 3 is a section along X-X of FIG. 2.
Figure 4:
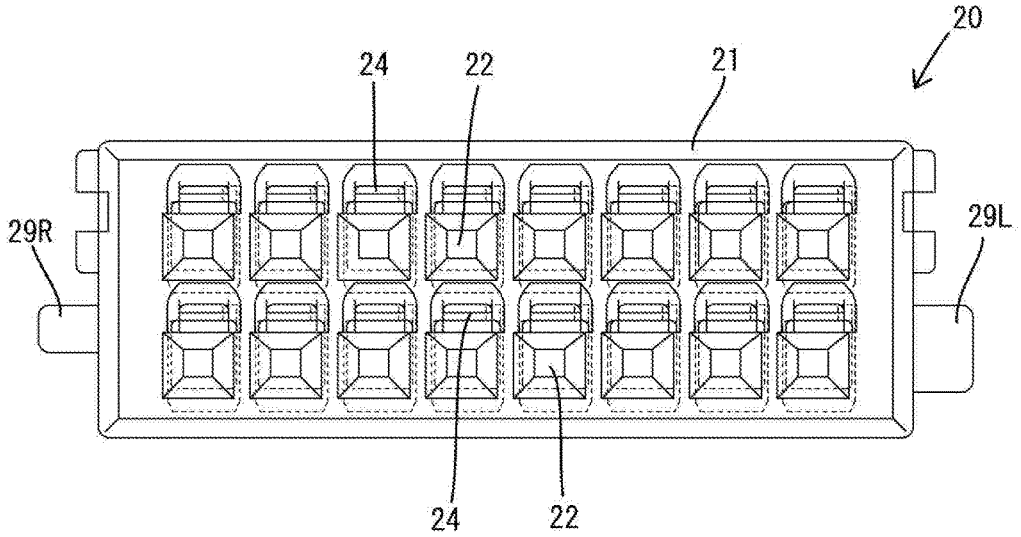
FIG. 4 is a front view of a sub-connector in a state where a retainer is at a full locking position.

The housing 10 is made of synthetic resin and is a vertically long block. Upper and lower parts of the housing 10 define terminal holding portions 11, and, as shown in FIGS. 1 to 3, a central part of the housing 10 in the vertical direction defines an accommodating portion 12 for four sub-connectors 20. The inside of the accommodating portion 12 defines an accommodation space 13 with substantially rectangular openings at the front and rear of the housing 10.

The accommodation space 13 is a single space without any partition over its entirety. Four (i.e. as many as the sub-connectors 20 to be accommodated into the accommodation space 13) left guide recesses 14L are formed on an inner surface of a left wall of the accommodating portion 12 and define long narrow grooves that extend in the front-rear direction while being spaced apart in the vertical direction. Four (i.e. as many as the sub-connectors 20 to be accommodated into the accommodation space 13) right guide recesses 14L are formed on an inner surface of a right wall of the accommodating portion 12 and define long narrow grooves that extend in the front-rear direction while being spaced apart in the vertical direction.

Formation areas of the left and right guide recesses 14L, 14R in the front-rear direction are from a position slightly behind the front end of the accommodation space 13 to the rear end of the accommodation space 13. Thus, the front ends of the left and right guide recesses 14L, 14R are not open in the front end surface of the accommodating portion 12 and function as stoppers 15. The rear ends of the left and right guide recesses 14L, 14R are open in the rear end surface of the accommodating portion 12.

As shown in FIGS. 1 and 2, the four left guide recesses 14L and the four right guide recesses 14R are arranged at substantially corresponding positions in the vertical direction. The left and right guide recesses 14L, 14R have substantially rectangular shapes in a back view. A lateral dimension (depth) of the left guide recesses 14L is substantially equal to a lateral dimension (depth) of the right guide recesses 14R. However, a vertical dimension (height) of the right guide recesses 14R is smaller than that of the left guide recesses 14L.

<Sub-Connector 20>

Figure 7:
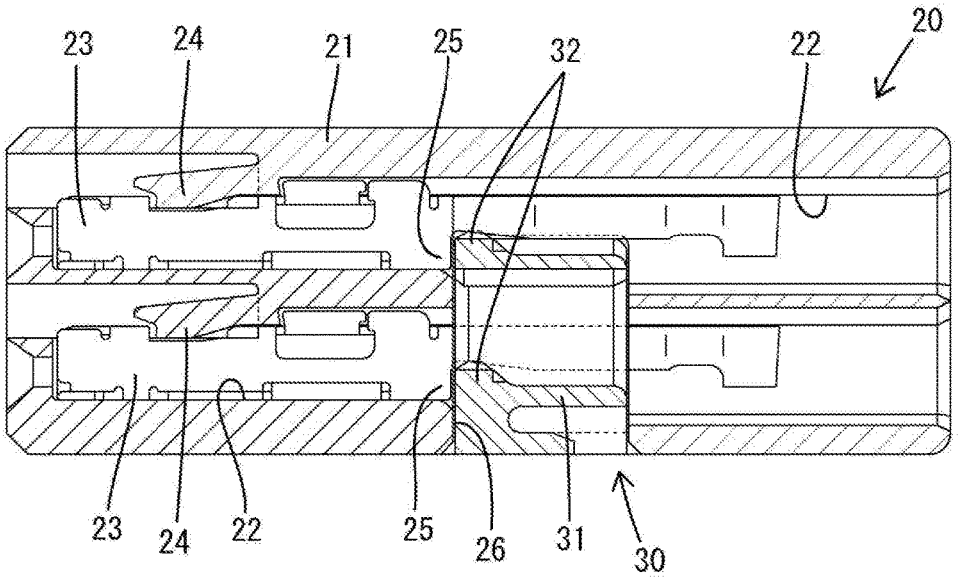
FIG. 7 is a side view in section of the sub-connector in the state where the retainer is at the full locking position.
Figure 10:
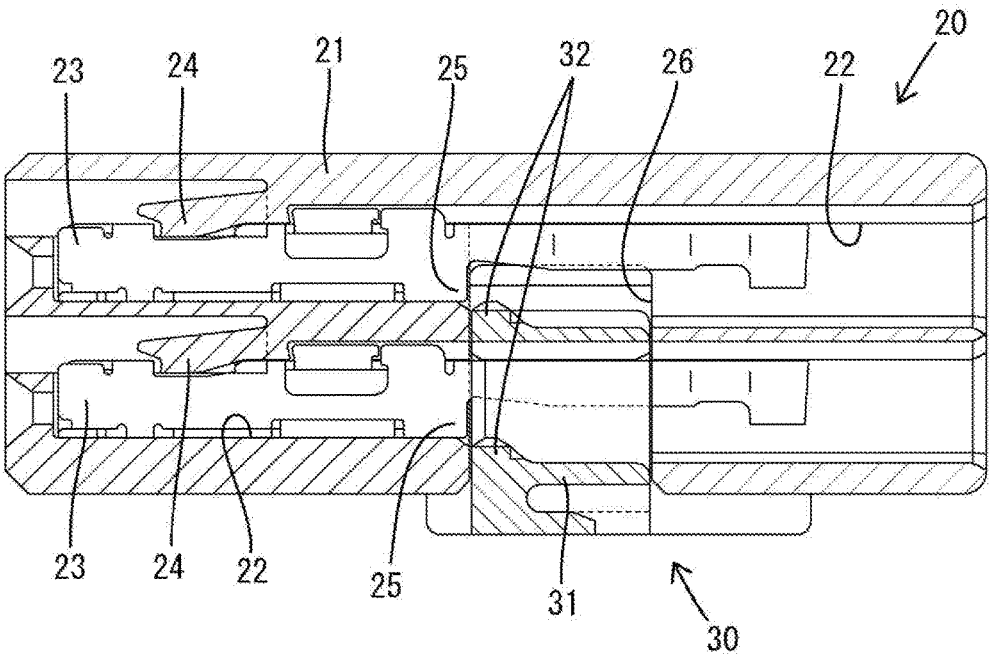
FIG. 10 is a side view in section of the sub-connector in the state where the retainer is at the partial locking position.

Each sub-connector 20 includes one connector body 21, a plurality of terminal fittings 23 and one retainer 30. The connector body 21 is made of synthetic resin and is in the form of a laterally long block. As shown in FIGS. 7 and 10, terminal accommodating chambers 22 are formed inside the connector body 21. The female terminal fittings 23 are inserted respectively into the terminal accommodating chambers 22 from behind the connector body 21, and the inserted terminal fitting 23 is retained by the locking action of a locking lance 24. A stepped locking portion 25 is formed on the lower surface of the terminal fitting 23. The terminal fitting 23 is retained by the locking lance 24 and also by having the locking portion 25 locked by the retainer 30. A wire (not shown) is fixed to a rear part of the terminal fitting 23 and is drawn out rearwardly from the connector body 21.

Figure 5:
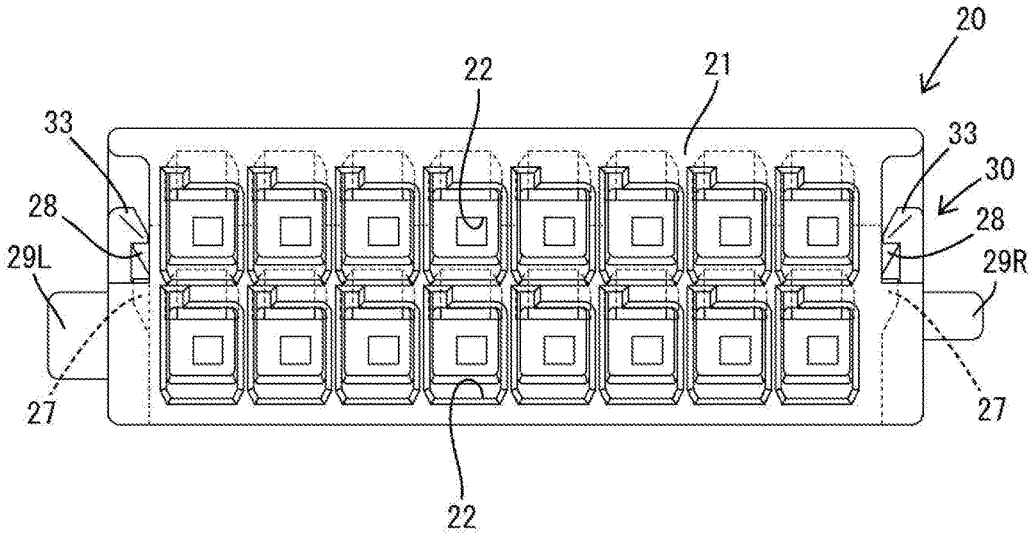
FIG. 5 is a back view of the sub-connector in the state where the retainer is at the full locking position.
Figure 6:
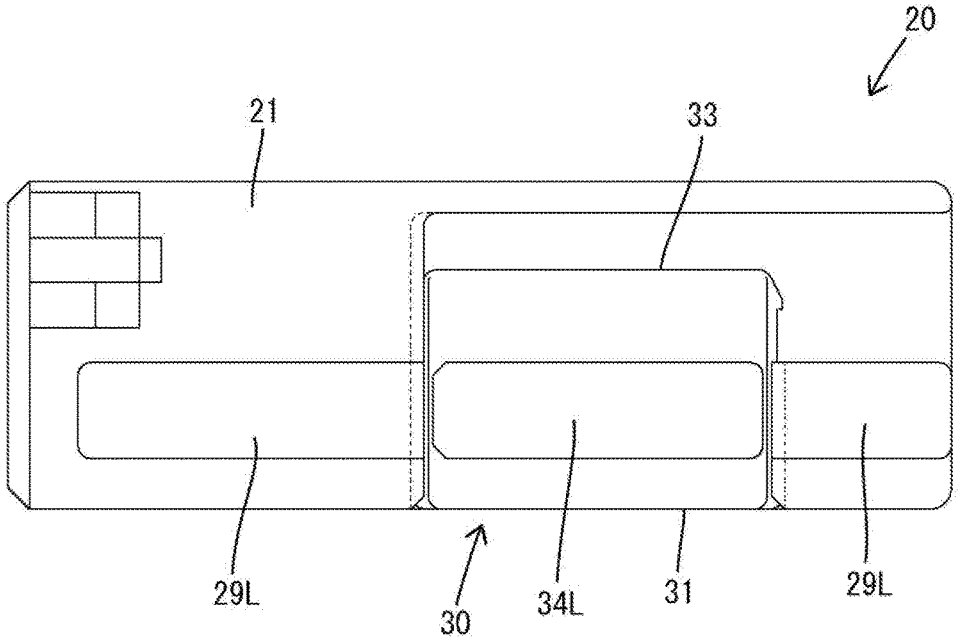
FIG. 6 is a side view of the sub-connector in the state where the retainer is at the full locking position.
Figure 8:
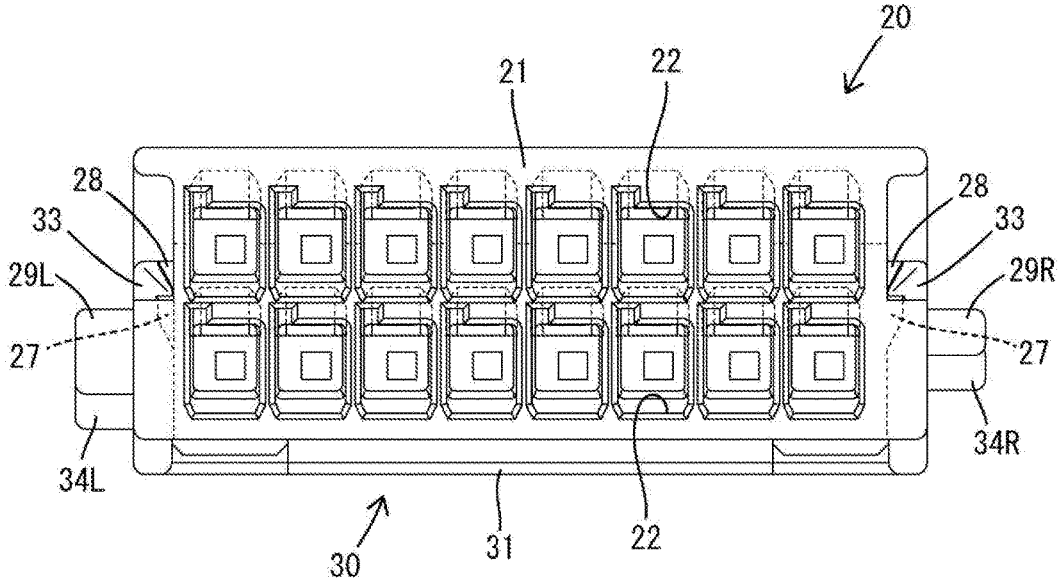
FIG. 8 is a back view of the sub-connector in a state where the retainer is at a partial locking position.
Figure 9:
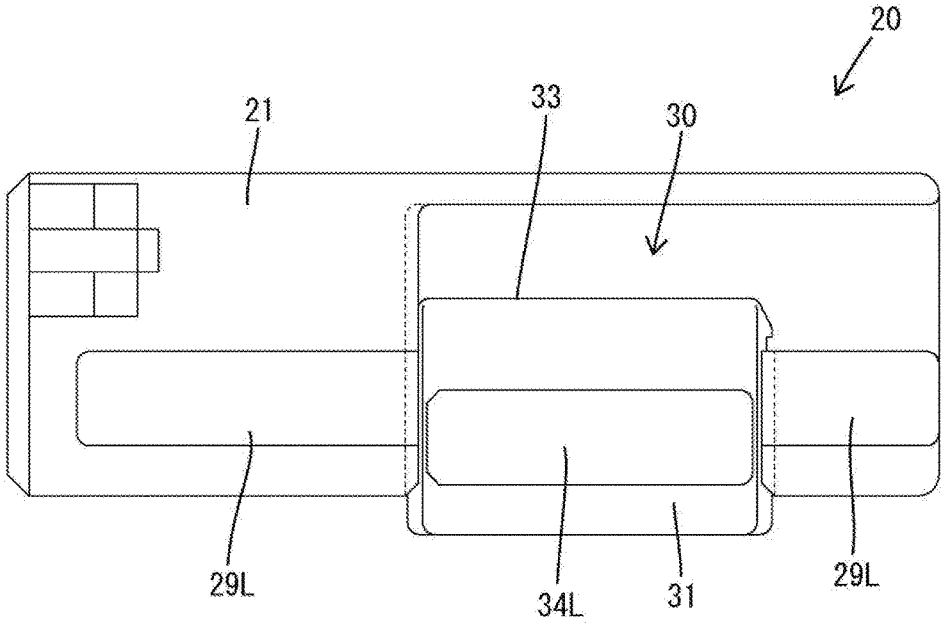
FIG. 9 is a side view of the sub-connector in the state where the retainer is at the partial locking position.

The connector body 21 is formed with a mounting space 26 that is open in the lower surface of the connector body 21 and communicates with all of the terminal fittings 22. As shown in FIGS. 5 and 8, two partial locking projections 27 and two common locking projections 28 are formed on left and right outer side surfaces of the connector body 21. The partial locking projections 27 hold the retainer 30 at a partial locking position. The common locking projections 28 hold the retainer 30 at a full locking position and at the partial locking position.

As shown in FIGS. 4 to 9, left guide projections 29L are formed on the left outer side surface of the connector body 21 and are spaced apart in the front-rear direction across the retainer 30. The front and rear left guide projections 29L are ribs extending in the front-rear direction (parallel to a mounting direction of the sub-connector 20 into the accommodating portion 12) and are at the same height in the vertical direction. Two right guide projections 29R are formed on the right outer side surface of the connector body 21 and are spaced apart in the front-rear direction across the retainer 30. The front and rear right guide projections 29R are ribs extending in the front-rear direction and are at the same height in the vertical direction.

The left guide projections 29L are substantially rectangular in a back view and fit into the left guide recess 14L without rattling in the vertical and lateral directions when mounting the sub-connector 20 into the accommodating portion 12. Similarly, the right guide projections 29R are substantially rectangular in a back view and fit into the right guide recess 14R without rattling in the vertical and lateral directions when mounting the sub-connector 20 into the accommodating portion 12.

<Retainer 30>

The retainer 30 has a wide blocked retaining function portion 31 and two bilaterally symmetrical resilient locking pieces 33 formed on left and right outer side surfaces of the retaining function portion 31 (see FIG. 5). As shown in FIGS. 7 and 10, the retaining function portion 31 has retaining portions 32 capable of locking the locking portions 25 of the terminal fittings 23 individually inserted into the terminal accommodating chambers 22 from behind.

The retainer 30 is mounted by inserting the retaining function portion 31 into the mounting space 26 from below the connector body 21. The mounted retainer 30 is slidable in the vertical direction between the partial locking position (see FIGS. 8 to 10) and the full locking position (see FIGS. 4 to 7) above the partial locking position with respect to the connector body 21. The left and right resilient locking pieces 33 are locked to the partial locking projections 27 and the common locking projections 28 to hold the retainer 30 at the partial locking position. Further, the left and right resilient locking pieces 33 are locked to the common locking projections 28 to hold the retainer 30 at the full locking position.

The retaining portions 32 are retracted down from insertion paths for the terminal fittings 23 in the terminal accommodating chambers 22 when the retainer 30 is at the partial locking position, so that the terminal fittings 23 can be inserted into the terminal accommodating chambers 22. Further, a lower end part of the retaining function portion 31 projects down than the lower surface of the connector body 21 at the partial locking position. The retainer 30 can be moved from the partial locking position to the full locking position when all of the terminal fittings 23 are inserted properly in the terminal accommodating chambers 22.

Movement of the retainer 30 to the full locking position causes the retaining portions 32 to enter the terminal accommodating chambers 22 and lock the locking portions 25 of the properly inserted terminal fittings 23 from behind. This locking action retains the terminal fittings 23. The entire retaining function portion 31 is accommodated in the mounting space 26 with the retainer 30 at the full locking position.

The retainer will interfere with the lower surface of the terminal fitting 23 if an attempt is made to move the retainer 30 from the partial locking position to the full locking position if any one of the terminal fittings is inserted insufficiently in the respective terminal accommodating chambers 22. As a result, the retainer 30 cannot be moved to the full locking position A left detecting projection 34L is formed on the left outer side surface of the retainer 30 and defines a rib extending in the front-rear direction. The left detecting projection 34L is formed continuously from the front end to the rear end of the retainer 30 and has a substantially rectangular shape in a back view. A lateral projecting dimension of the left detecting projection 34L from the retainer 30 is equal to a lateral projecting dimension of the left guide projections 29L from the connector body 21 and a vertical dimension of the left detecting projection 34L is equal to that of the left guide projections 29L.

A right detecting projection 34R is formed on the right outer side surface of the retainer 30 and defines a rib extending in the front-rear direction. The right detecting projection 34R is formed continuously from the front end to the rear end of the retainer 30. The right detecting projection 34R has a substantially rectangular shape in a back view. A lateral projecting dimension of the right detecting projection 34R from the retainer 30 is equal to a lateral projecting dimension of the right guide projections 29R from the connector body 21 and a vertical dimension of the right detecting projection 34R is equal to that of the right guide projections 29R.

With the retainer 30 at the full locking position, the left detecting projection 34L is at the same height as the left guide projections 29L and the right detecting projection 34R is at the same height as the right guide projections 29R in the vertical direction. With the retainer 30 at the partial locking position, the left detecting projection 34L is lower than the left guide projections 29L and the right detecting projection 34R is lower than the right guide projections 29R. That is, there are height differences between the left guide projections 29L and the left detecting projection 34L and between the right guide projections 29R and the right detecting projection 34R.

<Functions and Effects of Embodiment>

In assembling the split connector of this embodiment, the terminal fittings 23 are inserted into the connector body 21 in the sub-connector 20 while the retainer 30 is at the partial locking position with respect to the connector body 21. The retainer 30 is pushed to the full locking position after all terminal fittings 23 have been inserted.

The retainer 30 cannot be pushed to the full locking position if any terminal fitting 23 is not inserted sufficiently into the terminal accommodating chambers 22. Thus, the presence of an insufficiently inserted terminal fitting 23 can be detected based on whether the retainer 30 can be pushed to the full locking position, thereby completing the assembling of the sub-connector 20.

The assembled sub-connector 20 is mounted into the accommodation space 13 from behind the housing 10 so that the left guide projections 29L and the left detecting projection 34L fit into the left guide recess 14L and the right guide projections 29R and the right detecting projection 34R fit into the right guide recess 14R. As a result, the sub-connector 20 is positioned in the vertical direction and lateral direction with respect to the housing 10. When the sub-connector 20 is mounted properly into the accommodation space 13, the front ends of the left and right guide projections 29L, 29R on the front side butt against the stoppers 15 of the left and right guide recesses 14L, 14R to stop the sub-connector 20 in front.

The left and right detecting projections 34L, 34R of the retainer 30 remain displaced down from the left and right guide projections 29L, 29R if the retainer 30 is not moved from the partial locking position to the full locking position. An attempt may be made to mount the sub-connector 20 into the accommodating portion 12 in this state, and the left and right guide projections 29L, 29R on the front side will fit into the left and right guide recesses in an initial stage of the mounting. However, the detecting projections 34L, 34R that are displaced down from the guide projections 29L, 29R and the guide recesses 14L, 14R subsequently butt against rear surfaces of left and right side walls of the accommodating portion 12. Thus, the sub-connector 20 cannot be mounted into the accommodating portion 12, and it is known that the retainer 30 is at the partial locking position.

The split connector of this embodiment includes the housing 10 with the accommodating portion 12, the sub-connectors 20 insertable into the accommodating portion 12, the terminal fittings 23 to be inserted into the connector bodies 21 of the sub-connectors 20 and the retainers 30 to be mounted into the connector bodies 21. The retainer 30 is slidable in a direction intersecting with an inserting direction of the terminal fittings 23 between the partial locking position and the full locking position. The retainer 30 allows the insertion of the terminal fittings 23 at the partial locking position and locks and retains the inserted terminal fittings 23 at the full locking position.

The left guide recesses 14L and the right guide recesses 14R are formed on the inner surface of the accommodating portion 12 and extend parallel to the inserting direction of the sub-connectors 20 into the accommodating portion 12. The left guide projections 29L and the right guide projections 29R are formed on the outer surface of the sub-connector 20 and can fit into the left guide recess 14L and the right guide recess 14R in the inserting process into the accommodating portion 12. The left detecting projection 34L and the right detecting projection 34R are formed on the outer surface of the retainer 30. When the retainer 30 is at the partial locking position, the left and right detecting projections 34L, 34R cannot fit into the left and right guide recesses 14L, 14R. The left and right detecting projections 34L, 34R can fit into the left and right guide recesses 14L, 14R only when the retainer 30 is at the full locking position.

When the retainer 30 is at the partial locking position, the left and right detecting projections 34L, 34R interfere with an opening edge on the rear of the accommodating portion 12 in the process of inserting the sub-connector 20 into the accommodating portion 12, and this interference indicates that the retainer 30 is at the partial locking position. The retainer 30 is not pivoted about a hinge, but slid in the direction intersecting the inserting direction of the terminal fittings 23. Thus, even if the left and right detecting projections 34L, 34R interfere with the opening edge part of the accommodating portion 12, the retainer 30 remains held at the partial locking position and reliably indicate that the retainer 30 is at the partial locking position.

The left and right detecting projections 34L, 34R align with the left and right guide projections 29L, 29R when the retainer 30 is at the full locking position. According to this configuration, the partial or full locking position the retainer 30 can be confirmed visually.

The left guide projection 29L has a larger vertical dimension than the right guide projections 29R and the right guide recess 14R and interferes with the opening edge of the accommodating portion 12 without being able to be fit into the right guide recess 14R if the sub-connector 20 is inverted with respect to an axis parallel to the inserting direction during an insertion attempt into the accommodating portion 12. Thus, the sub-connector 20 cannot be inserted into the accommodating portion 12 in a laterally inverted improper orientation.

The guide recesses 14L, 14R, the guide projections 29L, 29R and the detecting projections 34L, 34R are provided on both left and right sides. However, the shape and dimensions of the left guide recess 14L are different from those of the right guide recess 14R, the shape and dimensions of the left guide projections 29L are different from those of the right guide projections 29R and the shape and dimensions of the left detecting projection 34L are different from those of the right detecting projection 34R. Thus, the orientation of the sub-connector 20 can be confirmed visually before the operation of inserting the sub-connector 20 into the accommodating portion 12.

The invention is not limited to the above described and illustrated embodiment. For example, the following embodiments also are included in the scope of the invention.

In the above embodiment, the detecting projections align with the guide projections when the retainer is at the full locking position. However, the detecting projections may be displaced from the guide projections when the retainer is at the full locking position.

One guide recess, one guide projection and one detecting projection are provided on each of the left and right sides in the above embodiment. However, plural guide recesses, plural guide projections and plural detecting projections may be provided on each of the left and right sides or one each of these may be provided on either one of the left and right sides and a plurality of these may be provided on the other side. Further, when plural guide recesses and plural guide projections are provided, only one detecting projection may be provided or the number of the detecting projections may be smaller than those of the guide recesses and the guide projections.

The shapes and dimensions of the guide recesses, the guide projections and the detecting projections are different between the left and right sides as a means for restricting the insertion of the sub-connector in an inverted orientation into the accommodating portion in the above embodiment. However, the arrangements and numbers of the guide recesses, the guide projections and the detecting projections may be different between the left and right sides.

Four sub-connectors are accommodated into one accommodating portion in the above embodiment. However, there may be any number of the sub-connectors to be accommodated.

The accommodating portion has a single accommodation space with no partition in the above embodiment. However, partition walls may be provided in the accommodating portion for partitioning between adjacent sub-connectors.

The guide projections interfere with the opening edge of the accommodating portion when the sub-connector is being inserted into the accommodating portion in a laterally inverted orientation. However, the detecting projections may interfere with the opening edge of the accommodating portion when the sub-connector is going to be inserted in a laterally inverted orientation.

What is claimed is:

1. A split connector, comprising:

a housing including an accommodating portion;

a sub-connector insertable into the accommodating portion;

a terminal fitting to be inserted into the sub-connector;

a retainer to be mounted slidably into the sub-connector in a direction intersecting with an inserting direction of the terminal fitting between a partial locking position and a full locking position, the retainer being configured to allow insertion of the terminal fitting when the retainer is at the partial locking position and to retain the terminal fitting by locking the inserted terminal fitting at the full locking position;

a guide recess formed on an inner surface of the accommodating portion and extending parallel to an inserting direction of the sub-connector into the accommodating portion;

a guide projection formed on an outer surface of the sub-connector) and fittable into the guide recess; and a detecting projection formed on an outer surface of the retainer and configured not to fittable into the guide recess when the retainer is at the partial locking position and being fittable into the guide recess only when the retainer is at the full locking position.

2. The split connector of claim 1, wherein the detecting projection is arranged to be aligned with the guide projection when the retainer is at the full locking position.

3. The split connector of claim 2, wherein one of the guide projection and the detecting projection interferes with an opening edge part of the accommodating portion when the sub-connector is going to be inserted into the accommodating portion in a laterally inverted orientation with respect to an axis parallel to the inserting direction.

4. The split connector of claim 3, wherein the guide recess, the guide projection and the detecting projection are provided on each of left and right sides, and shapes and dimensions of the guide recesses, the guide projections and the detecting projections are different between the left and right sides.

5. The split connector of claim 1, wherein one of the guide projection and the detecting projection interferes with an opening edge part of the accommodating portion when the sub-connector is going to be inserted into the accommodating portion in a laterally inverted orientation with respect to an axis parallel to the inserting direction.

6. The split connector of claim 5, wherein the guide recess, the guide projection and the detecting projection are provided on each of left and right sides, and shapes and dimensions of the guide recesses, the guide projections and the detecting projections are different between the left and right sides.

7. The split connector of claim 1, wherein the guide recess, the guide projection and the detecting projection are provided on each of left and right sides, and shapes and dimensions of the guide recesses, the guide projections and the detecting projections are different between the left and right sides.

* * * * *